US011621011B2

(12) United States Patent
Klejsa et al.

(10) Patent No.: US 11,621,011 B2
(45) Date of Patent: Apr. 4, 2023

(54) METHODS AND APPARATUS FOR RATE QUALITY SCALABLE CODING WITH GENERATIVE MODELS

(71) Applicant: Dolby International AB, Amsterdam Zuidoost (NL)

(72) Inventors: Janusz Klejsa, Bromma (SE); Per Hedelin, Gothenburg (SE)

(73) Assignee: Dolby International AB, Amsterdam Zuidoost (NL)

( * ) Notice: Subject to any disclaimer, the term of this patent is extended or adjusted under 35 U.S.C. 154(b) by 141 days.

(21) Appl. No.: 17/290,193

(22) PCT Filed: Oct. 29, 2019

(86) PCT No.: PCT/EP2019/079508
§ 371 (c)(1),
(2) Date: Apr. 29, 2021

(87) PCT Pub. No.: WO2020/089215
PCT Pub. Date: May 7, 2020

(65) Prior Publication Data

US 2022/0044694 A1 Feb. 10, 2022

Related U.S. Application Data

(60) Provisional application No. 62/752,031, filed on Oct. 29, 2018.

(51) Int. Cl.
*G10L 19/06* (2013.01)
*G10L 19/032* (2013.01)
(Continued)

(52) U.S. Cl.
CPC ..... *G10L 19/06* (2013.01); *G10L 19/032* (2013.01); *G10L 19/24* (2013.01); *G10L 25/30* (2013.01)

(58) Field of Classification Search
CPC ..... G10L 19/06; G10L 19/24
See application file for complete search history.

(56) References Cited

U.S. PATENT DOCUMENTS 6,092,039 A 7/2000 Zingher
7,596,491 B1 * 9/2009 Stachurski ..... G10L 19/12 704/223

(Continued)

FOREIGN PATENT DOCUMENTS

JP 01276200 A 11/1989
JP 2001519551 A 10/2001
JP 2003512639 A 4/2003

OTHER PUBLICATIONS

W. B. Kleijn et al., "Wavenet Based Low Rate Speech Coding," 2018 IEEE International Conference on Acoustics, Speech and Signal Processing (ICASSP), 2018, pp. 676-680, doi: 10.1109/ICASSP.2018.8462529. (Year: 2018).*

(Continued)

*Primary Examiner* — Shaun Roberts

(57) ABSTRACT

Described herein is a method of decoding an audio or speech signal, the method including the steps of: (a) receiving, by a decoder, a coded bitstream including the audio or speech signal and conditioning information; (b) providing, by a bitstream decoder, decoded conditioning information in a format associated with a first bitrate; (c) converting, by a converter, the decoded conditioning information from the format associated with the first bitrate to a format associated with a second bitrate; and (d) providing, by a generative neural network, a reconstruction of the audio or speech signal according to a probabilistic model conditioned by the conditioning information in the format associated with the second bitrate. Described are further an apparatus for decoding an audio or speech signal, a respective encoder, a system of the encoder and the apparatus for decoding an audio or (Continued)

speech signal as well as a respective computer program product.

23 Claims, 10 Drawing Sheets

(51) Int. Cl.
*G10L 19/24* (2013.01)
*G10L 25/30* (2013.01)

(56) References Cited

U.S. PATENT DOCUMENTS

| | | | | |
|---|---|---|---|---|
| 8,325,622 | B2 * | 12/2012 | Feldbauer | H04N 19/164 375/240.03 |
| 9,240,184 | B1 | 1/2016 | Lin | |
| 9,400,955 | B2 | 7/2016 | Garimella | |
| 9,454,958 | B2 | 9/2016 | Li | |
| 9,508,347 | B2 | 11/2016 | Wang | |
| 9,520,128 | B2 | 12/2016 | Bauer | |
| 9,779,727 | B2 | 10/2017 | Yu | |
| 9,858,919 | B2 | 1/2018 | Saon | |
| 2008/0004883 | A1 * | 1/2008 | Vilermo | G10L 19/24 704/E19.044 |
| 2009/0112607 | A1 * | 4/2009 | Ashley | G10L 19/24 704/500 |
| 2017/0148433 | A1 | 5/2017 | Catanzaro | |
| 2018/0075343 | A1 | 3/2018 | Van Den Oord | |

OTHER PUBLICATIONS

Hu, Ya-Jun, et al "The USTC System for Blizzard Machine Learning Challenge 2017—ES2" IEEE Automatic Speech Recognition and Understanding Workshop, Dec. 16, 2017, pp. 650-656.

Juvela, L. et al. "Speaker-Independent Raw Waveform Model for Glottal Excitation" ARXIV.Org. Cornell University Library, Apr. 25, 2018.

Ronzhin, A. "Speech and Computer", 17th International Conference, SPECOM 2015. Proceedings, Springer International Publishing, xvi+506, 2015; ISBN-13: 978-3-319-23131-0; Located via: Engineering Village, Sep. 2015.

Sharma, D. et al "Non-Intrusive Bit-Rate Detection of Coded Speech" 2017 25th European Signal Processing Conference (EUSIPCO), pp. 1849-1853, 2017.

Ai, Y. et al "Samplernn-Based Neural Vocoder for Statistical Parametric Speech Synthesis" IEEE International Conference on Acoustics, Speech and Signal Processing, Apr. 20, 2018, pp. 5659-5663.

* cited by examiner

METHODS AND APPARATUS FOR RATE QUALITY SCALABLE CODING WITH GENERATIVE MODELS

CROSS-REFERENCE TO RELATED APPLICATION

This application claims priority of the following priority application: US provisional application 62/752,031 (reference: D18118USP1), filed 29 Oct. 2018, which is hereby incorporated by reference.

TECHNOLOGY

The present disclosure relates generally to a method of decoding an audio or speech signal, and more specifically to a method providing rate quality scalable coding with generative models. The present disclosure further relates to an apparatus as well as a computer program product for implementing said method and to a respective encoder and system.

While some embodiments will be described herein with particular reference to that disclosure, it will be appreciated that the present disclosure is not limited to such a field of use and is applicable in broader contexts.

BACKGROUND

Any discussion of the background art throughout the disclosure should in no way be considered as an admission that such art is widely known or forms part of common general knowledge in the field.

Recently, generative modeling for audio based on deep neural networks, such as WaveNet and SampleRNN, has provided significant advances in natural-sounding speech synthesis. The main application has been in the field of text-to-speech where the models replace the vocoding component.

Generative models can be conditioned by global and local latent representations. In the context of voice conversion, this facilitates natural separation of the conditioning into a static speaker identifier and dynamic linguistic information. However, despite the advancements made, there is still an existing need for providing audio or speech coding employing a generative model, in particular at low bitrates.

While the usage of generative models may improve coding performance, in particular at low bitrates, the application of such models is still challenging where the codec is expected to facilitate operation at multiple bitrates (allowing for multiple trade-off points between bitrate and quality).

SUMMARY

In accordance with a first aspect of the present disclosure there is provided a method of decoding an audio or speech signal. The method may include the step of (a) receiving, by a receiver, a coded bitstream including the audio or speech signal and conditioning information. The method may further include the step of (b) providing, by a bitstream decoder, decoded conditioning information in a format associated with a first bitrate. The method may further include the step of (c) converting, by a converter, the decoded conditioning information from the format associated with the first bitrate to a format associated with a second bitrate. And the method may include the step of (d) providing, by a generative neural network, a reconstruction of the audio or speech signal according to a probabilistic model conditioned by the conditioning information in the format associated with the second bitrate.

In some embodiments, the first bitrate may be a target bitrate and the second bitrate may be a default bitrate.

In some embodiments, the conditioning information may include an embedded part and a non-embedded part.

In some embodiments, the conditioning information may include one or more conditioning parameters.

In some embodiments, the one or more conditioning parameters may be vocoder parameters.

In some embodiments, the one or more conditioning parameters may be uniquely assigned to the embedded part and the non-embedded part.

In some embodiments, the conditioning parameters of the embedded part may include one or more of reflection coefficients from a linear prediction filter, or a vector of subband energies ordered from low frequencies to high frequencies, or coefficients of the Karhunen-Loeve transform, or coefficients of a frequency transform.

In some embodiments, a dimensionality, which may be defined as a number of the conditioning parameters, of the embedded part of the conditioning information associated with the first bitrate may be lower than or equal to the dimensionality of the embedded part of the conditioning information associated with the second bitrate, and the dimensionality of the non-embedded part of the conditioning information associated with the first bitrate may be the same as the dimensionality of the non-embedded part of the conditioning information associated with the second bitrate.

In some embodiments, step (c) may further include: (i) extending the dimensionality of the embedded part of the conditioning information associated with the first bitrate to the dimensionality of the embedded part of the conditioning information associated with the second bitrate by means of zero padding; or (ii) extending the dimensionality of the embedded part of the conditioning information associated with the first bitrate to the dimensionality of the embedded part of the conditioning information associated with the second bitrate by means of predicting any missing conditioning parameters based on the available conditioning parameters of the conditioning information associated with the first bitrate.

In some embodiments, step (c) may further include converting, by the converter, the non-embedded part of the conditioning information by copying values of the conditioning parameters from the conditioning information associated with the first bitrate into respective conditioning parameters of the conditioning information associated with the second bitrate.

In some embodiments, the conditioning parameters of the non-embedded part of the conditioning information associated with the first bitrate may be quantized using a coarser quantizer than for the respective conditioning parameters of the non-embedded part of the conditioning information associated with the second bitrate.

In some embodiments, the generative neural network may be trained based on conditioning information in the format associated with the second bitrate.

In some embodiments, the generative neural network may reconstruct the signal by performing sampling from a conditional probability density function, which is conditioned using the conditioning information in the format associated with the second bitrate.

In some embodiments, the generative neural network may be a SampleRNN neural network.

In some embodiments, the SampleRNN neural network may be a four-tier SampleRNN neural network.

In accordance with a second aspect of the present disclosure there is provided an apparatus for decoding an audio or speech signal. The apparatus may include (a) a receiver for receiving a coded bitstream including the audio and speech signal and conditioning information. The apparatus may further include (b) a bitstream decoder for decoding the coded bitstream to obtain decoded conditioning information in a format associated with a first bitrate. The apparatus may further include (c) a converter for converting the decoded conditioning information from a format associated with the first bitrate to a format associated with a second bitrate. And the apparatus may include (d) a generative neural network for providing a reconstruction of the audio or speech signal according to a probabilistic model conditioned by the conditioning information in the format associated with the second bitrate.

In some embodiments, the first bitrate may be a target bitrate and the second bitrate may be a default bitrate.

In some embodiments, the conditioning information may include an embedded part and a non-embedded part.

In some embodiments, the conditioning information may include one or more conditioning parameters.

In some embodiments, the one or more conditioning parameters may be vocoder parameters.

In some embodiments, the one or more conditioning parameters may be uniquely assigned to the embedded part and the non-embedded part.

In some embodiments, the conditioning parameters of the embedded part may include one or more of reflection coefficients from a linear prediction filter, or a vector of subband energies ordered from low frequencies to high frequencies, or coefficients of the Karhunen-Loeve transform, or coefficients of a frequency transform.

In some embodiments, a dimensionality, which is defined as a number of the conditioning parameters, of the embedded part of the conditioning information associated with the first bitrate may be lower than or equal to the dimensionality of the embedded part of the conditioning information associated with the second bitrate, and the dimensionality of the non-embedded part of the conditioning information associated with the first bitrate may be the same as the dimensionality of the non-embedded part of the conditioning information associated with the second bitrate.

In some embodiments, the converter may further be configured to: (i) extend the dimensionality of the embedded part of the conditioning information associated with the first bitrate to the dimensionality of the embedded part of the conditioning information associated with the second bitrate by means of zero padding; or (ii) extend the dimensionality of the embedded part of the conditioning information associated with the first bitrate to the dimensionality of the embedded part of the conditioning information associated with the second bitrate by means of predicting any missing conditioning parameters based on the available conditioning parameters of the conditioning information associated with the first bitrate.

In some embodiments, the converter may further be configured to convert the non-embedded part of the conditioning information by copying values of the conditioning parameters from the conditioning information associated with the first bitrate into respective conditioning parameters of the conditioning information associated with the second bitrate.

In some embodiments, the conditioning parameters of the non-embedded part of the conditioning information associated with the first bitrate may be quantized using a coarser quantizer than for the respective conditioning parameters of the non-embedded part of the conditioning information associated with the second bitrate.

In some embodiments, the generative neural network may be trained based on conditioning information in the format associated with the second bitrate.

In some embodiments, the generative neural network may reconstruct the signal by performing sampling from a conditional probability density function, which is conditioned using the conditioning information in the format associated with the second bitrate.

In some embodiments, the generative neural network may be a SampleRNN neural network.

In some embodiments, the SampleRNN neural network may be a four-tier SampleRNN neural network.

In accordance with a third aspect of the present disclosure there is provided an encoder including a signal analyzer and a bitstream encoder, wherein the encoder may be configured to provide at least two operating bitrates, including a first bitrate and a second bitrate, wherein the first bitrate is associated with a lower level of quality of reconstruction than the second bitrate, and wherein the first bitrate is lower than the second bitrate.

In some embodiments, the encoder may further be configured to provide conditioning information associated with the first bitrate including one or more conditioning parameters uniquely assigned to an embedded part and a non-embedded part of the conditioning information.

In some embodiments, a dimensionality, which may be defined as a number of the conditioning parameters, of the embedded part of the conditioning information and of the non-embedded part of the conditioning information may be based on the first bitrate.

In some embodiments, the conditioning parameters of the embedded part may include one or more of reflection coefficients from a linear prediction filter, or a vector of subband energies ordered from low frequencies to high frequencies, or coefficients of the Karhunen-Loeve transform, or coefficients of a frequency transform.

In some embodiments, the first bitrate may belong to a set of multiple operating bitrates.

In accordance with a fourth aspect of the present disclosure there is provided a system of an encoder and an apparatus for decoding an audio or speech signal.

In accordance with a fifth aspect of the present disclosure there is provided a computer program product comprising a computer-readable storage medium with instructions adapted to cause the device to carry out the method of decoding an audio or speech signal when executed by a device having processing capability.

BRIEF DESCRIPTION OF THE DRAWINGS

Example embodiments of the disclosure will now be described, by way of example only, with reference to the accompanying drawings in which.

DESCRIPTION OF EXAMPLE EMBODIMENTS

Rate Quality Scalable Coding with Generative Models

Provided is a coding structure that is trained to operate at a specific bitrate. This offers the advantage that training a decoder for a set of predefined bitrates is not required (which would likely require increasing the complexity of the underlying generative model), further using a set of decoders is also not required, wherein each of the decoders would have to be trained and associated with a specific operating bitrate which would also significantly increase the complexity of the generative model. In other words, if a codec is expected to operate at multiple rates, for example R1<R2<R3, one would either need a collection of generative models (generative models for R1, R2, and R3) for each respective bitrate or one bigger model capturing complexity of operation at multiple bitrates.

Accordingly, as described herein, in that the generative model is not retrained (or only a limited portion is retrained), the complexity of the generative model is not increased to facilitate operation at multiple bitrates related to the quality vs bitrate trade-off. In other words, the present disclosure provides operation of a coding scheme at bitrates for which it has not been trained using a single model.

Figure 6:
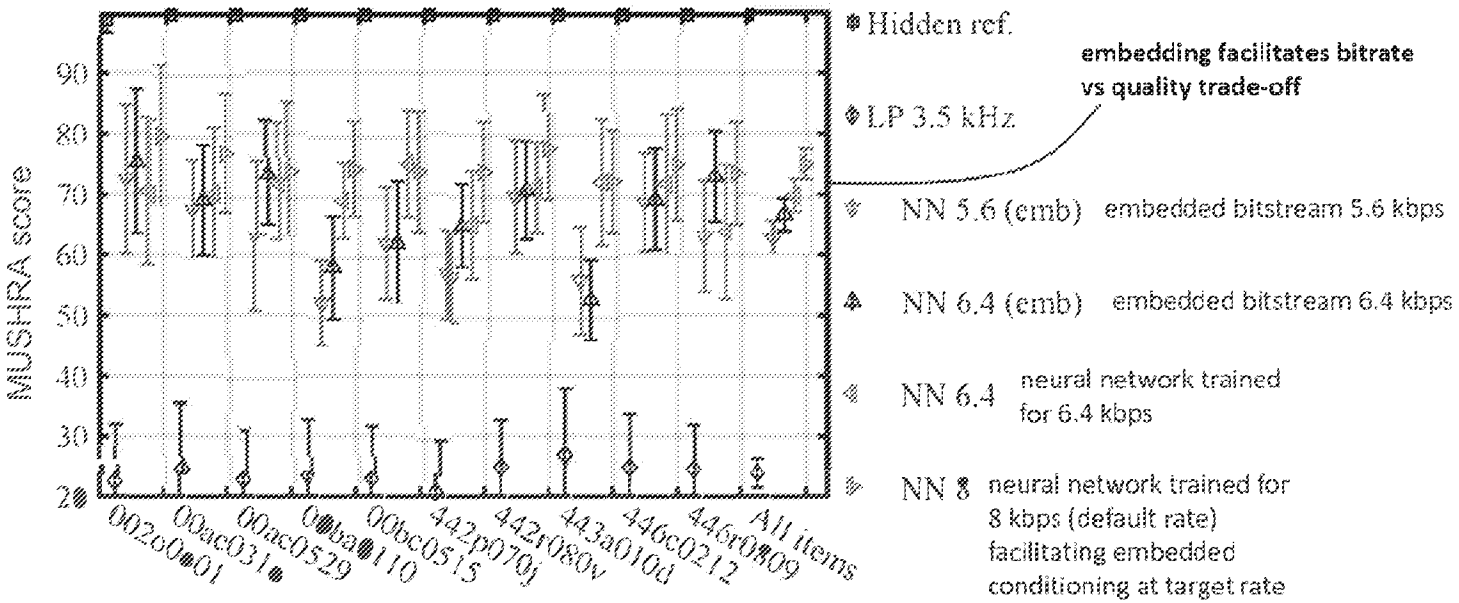
FIG. 6 illustrates results of a listening test.

The effect of the coding structure as described may for example be derived from FIG. 6. As shown in the example of FIG. 6, the coding structure includes an embedding technique that facilitates a meaningful rate-quality trade-off Specifically, in the provided example, the embedding technique facilitates achieving multiple quality vs rate trade-off points (5.6 kbps and 6.4 kbps) with a generative neural network trained to operate with conditioning at 8 kbps.

Method and Apparatus for Decoding an Audio or Speech Signal

Figure 1A:
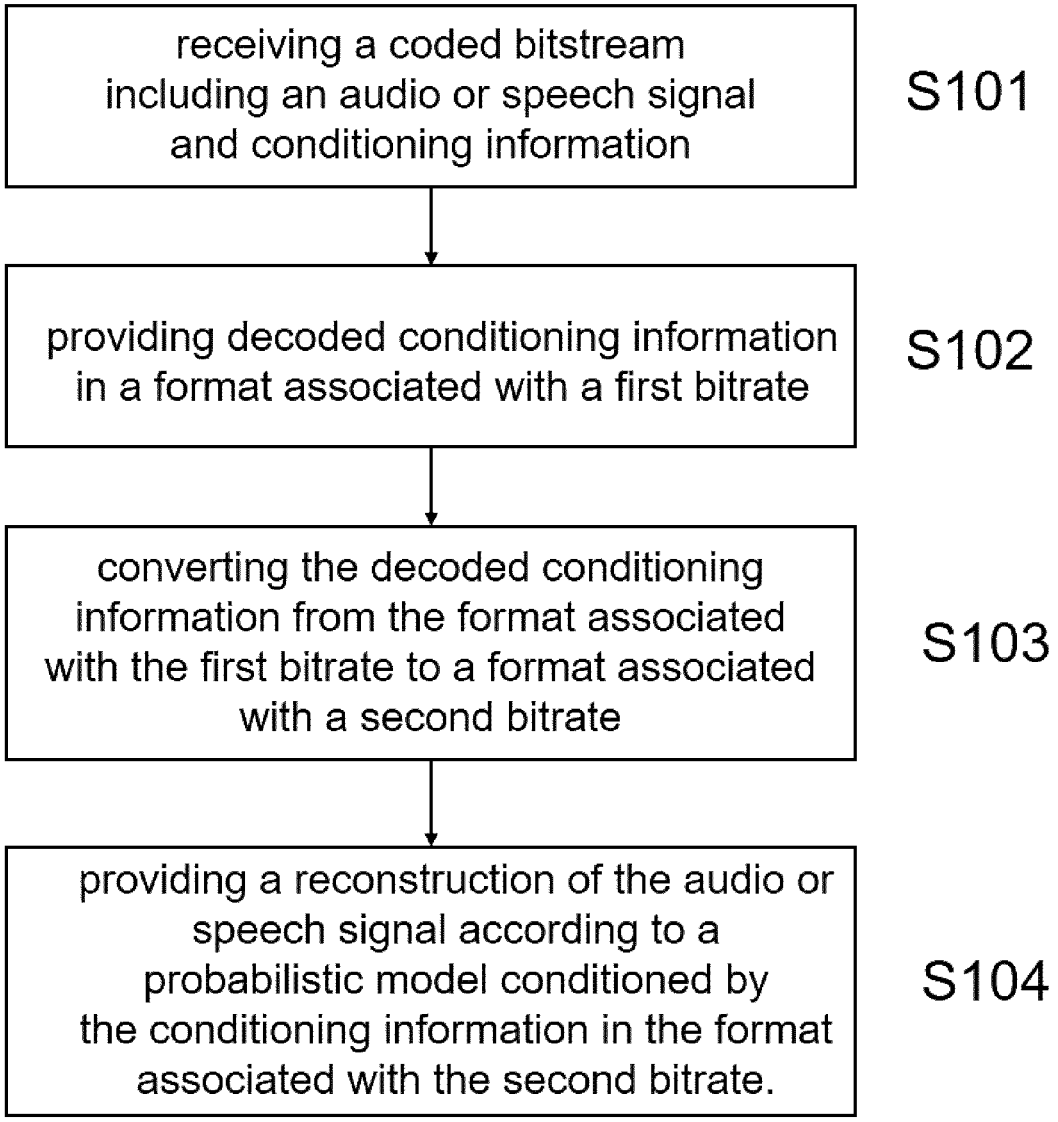
FIG. 1*a* illustrates a flow diagram of an example of a method of decoding an audio or speech signal employing a generative neural network.

Referring to the example of FIG. 1*a*, a flow diagram of a method of decoding an audio or speech signal is illustrated. In step S101, a coded bitstream including an audio or speech signal and conditioning information is received, by a receiver. The received coded bitstream is then decoded by a bitstream decoder. The bitstream decoder thus provides in step S102 decoded conditioning information which is in a format associated with a first bitrate. In an embodiment, the first bitrate may be a target bitrate. Further, in step S103, the conditioning information is then converted, by a converter, from the format associated with the first bitrate to a format associated with a second bitrate. In an embodiment, the second bitrate may be a default bitrate. In step S104, reconstruction of the audio or speech signal is provided by a generative neural network according to a probabilistic model conditioned by the conditioning information in the format associated with the second bitrate.

The above described method may be implemented as a computer program product comprising a computer-readable storage medium with instructions adapted to cause the device to carry out the method when executed by a device having processing capability.

Alternatively, or additionally, the above described method may be implemented by an apparatus for decoding an audio or speech signal. Referring now to the example of FIG. 1*b*, an apparatus for decoding an audio or speech signal employing a generative neural network is illustrated. The apparatus may be a decoder, 100, that facilitates operation at a range of operating bitrates. The apparatus, 100, includes a receiver, 101, for receiving a coded bitstream including an audio or speech signal and conditioning information. The apparatus, 100, further includes a bitstream decoder, 102, for decoding the received coded bitstream to obtain decoded conditioning information in a format associated with a first bitrate. In an embodiment, the first bitrate may be a target bitrate. The bitstream decoder, 102, may also be said to provide reconstruction of the conditioning information at a first bitrate. The bitstream decoder, 102, may be configured to facilitate operation of the apparatus (decoder), 100, at a range of operating bitrates. The apparatus, 100, further includes a converter, 103. The converter, 103, is configured to convert the decoded conditioning information from the format associated with the first bitrate to a format associated with a second bitrate. In an embodiment, the second bitrate may be a default bitrate. Thus, the converter, 103, may be configured to process the decoded conditioning information to convert it from the format associated with the target bitrate to the format associated with the default bitrate. And the apparatus, 100, includes a generative neural network, 104. The generative neural network, 104, is configured to provide a reconstruction of the audio or speech signal according to a probabilistic model conditioned by the conditioning information in the format associated with the second bitrate. The generative neural network, 104, may thus operate on a default format of the conditioning information.

Conditioning Information

Figure 1B:
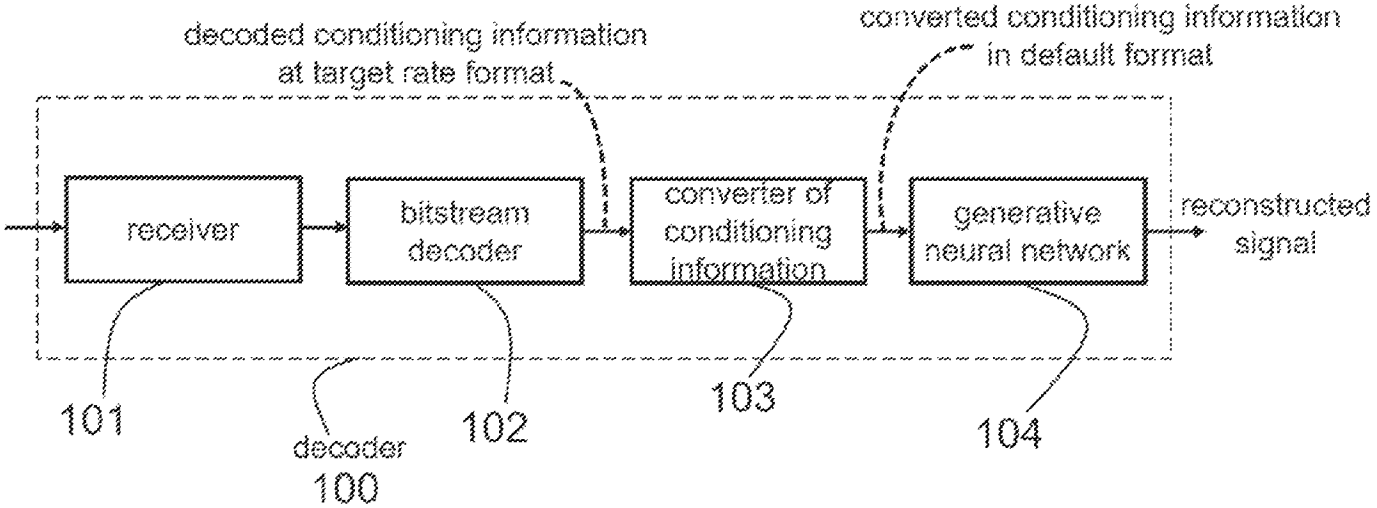
FIG. 1*b* illustrates a block diagram of an example of an apparatus for decoding an audio or speech signal employing a generative neural network.

As illustrated in the example of FIG. 1*b*, and mentioned above, the apparatus, 100, includes a converter, 103, configured for converting of conditioning information. The apparatus, 100, described in this disclosure may utilize a special construction of the conditioning information that may comprise two parts. In an embodiment, the conditioning information may include an embedded part and a non-embedded part. Alternatively, or additionally, the conditioning information may include one or more conditioning parameters. In an embodiment, the one or more conditioning parameters may be vocoder parameters. In an embodiment, the one or more conditioning parameters may be uniquely assigned to the embedded part and the non-embedded part. The conditioning parameters assigned to or included in the embedded part may also be denoted as embedded parameters, while the conditioning parameters assigned to or included in the non-embedded part may also be denoted as non-embedded parameters.

The operation of the coding scheme may, for example, be frame based, where a frame of a signal may be associated with the conditioning information. The conditioning information may include an ordered set of conditioning parameters or n-dimensional vector representing the conditioning parameters. Conditioning parameters within the embedded part of the conditioning information may be ordered according to their importance (for example according to decreasing importance). The non-embedded part may have a fixed dimensionality, wherein dimensionality may be defined as the number of conditioning parameters in the respective part.

In an embodiment, the dimensionality of the embedded part of the conditioning information associated with the first bitrate may be lower than or equal to the dimensionality of the embedded part of the conditioning information associated with the second bitrate, and the dimensionality of the non-embedded part of the conditioning information associated with the first bitrate may be the same as the dimensionality of the non-embedded part of the conditioning information associated with the second bitrate.

From the embedded part of the conditioning information associated with the second bitrate, one or more conditioning parameters may further be dropped according to their importance starting from the least important towards the most important. This may, for example, be done in a way that an approximate reconstruction (decoding) of the embedded part of the conditioning information associated with the first bitrate is still possible based on certain available identified most important conditioning parameters. As mentioned above, one advantage of the embedded part is that it facilitates a quality vs bitrate trade-off (This trade-off may be enabled by design of the embedded part of the conditioning. Examples of such designs are provided in additional embodiments in the description). For example, dropping the least important conditioning parameter in the embedded part would reduce the bitrate needed to encode this part of conditioning information, but would also decrease the reconstruction (decoding) quality in the coding scheme. Therefore, the reconstruction quality would degrade gracefully as the conditioning parameters are stripped-off from the embedded part of the conditioning information, for example at the encoder side.

In an embodiment, the conditioning parameters in the embedded part of the conditioning information may include one or more of (i) reflection coefficients derived from a linear prediction (filter) model representing the encoded signal; (ii) a vector of subband energies ordered from low frequencies to high frequencies; (iii) coefficients of the Karhunen-Loeve transform (e.g., arranged in the order of descending eigenvalues) or (iv) coefficients of a frequency transform (e.g., MDCT, DCT).

Figure 2A:
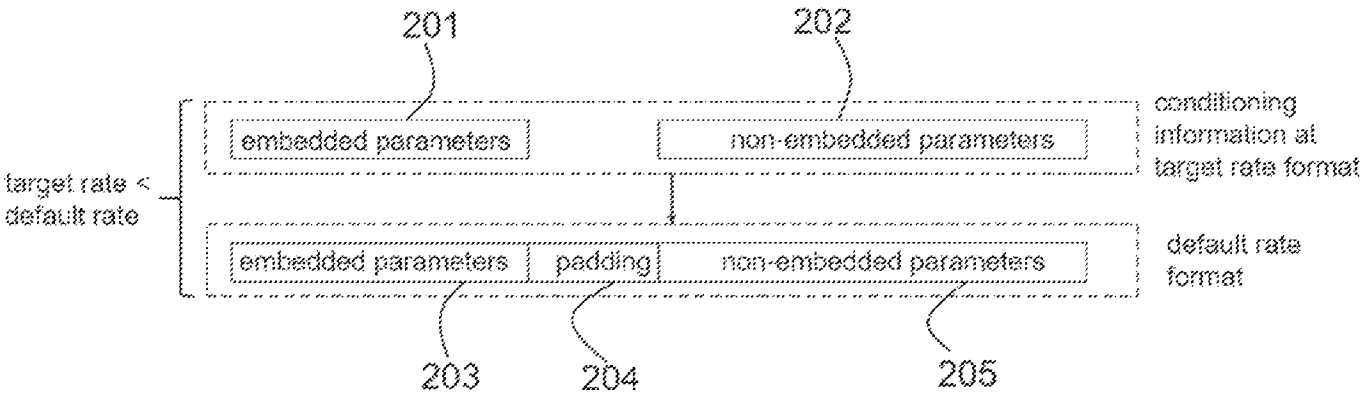
FIG. 2*a* illustrates a block diagram of an example of a converter which converts conditioning information from a target rate format to a default rate format by comparing embedded parameters and non-embedded parameters employing padding.

Referring now to the example of FIG. 2*a*, a block diagram of an example of a converter which converts conditioning information from a target rate format to a default rate format by comparing embedded parameters and non-embedded parameters employing padding is illustrated. In particular, the converter may be configured to convert the conditioning information from a format associated with a target bitrate to the default format for which the generative neural network has been trained. As illustrated, in the example of FIG. 2*a*, the target bitrate may be lower than the default bitrate. In this case, the embedded part of the conditioning information, 201, may be extended to a predefined default dimensionality, 203, by way of padding, 204. The dimensionality of the non-embedded part does not change, 202, 205. In an embodiment, the converter is configured to convert the non-embedded part of the conditioning information by copying values of the conditioning parameters from the conditioning information associated with the first bitrate into respective conditioning parameters of the conditioning information associated with the second bitrate.

Figure 2B:
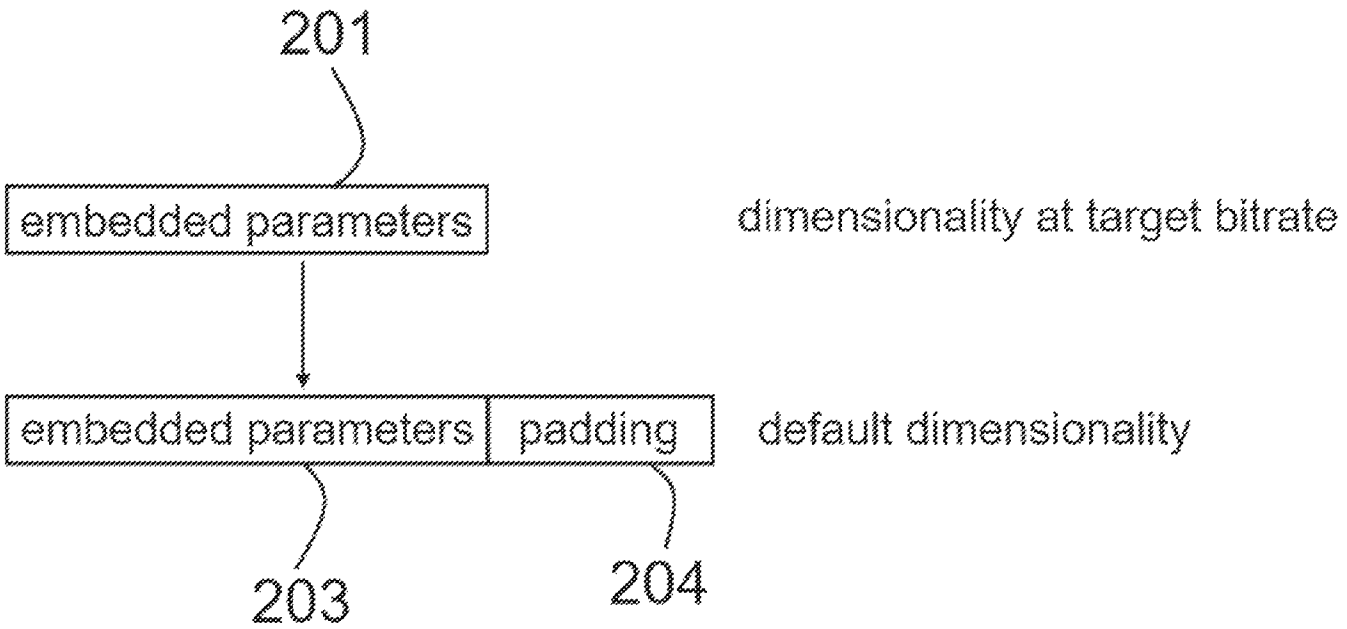
FIG. 2*b* illustrates a block diagram of an example of actions of a converter employing dimensionality conversion of the conditioning information.

The result of the padding operation, 204, on the conditioning parameters in the embedded part of the conditioning information with a dimensionality associated with the target (first) bitrate, 201, to yield the dimensionality of the conditioning parameters in the embedded part of the conditioning information associated with the default bitrate (second bitrate), 203, is further schematically illustrated in the example of FIG. 2*b*.

Figure 3A:
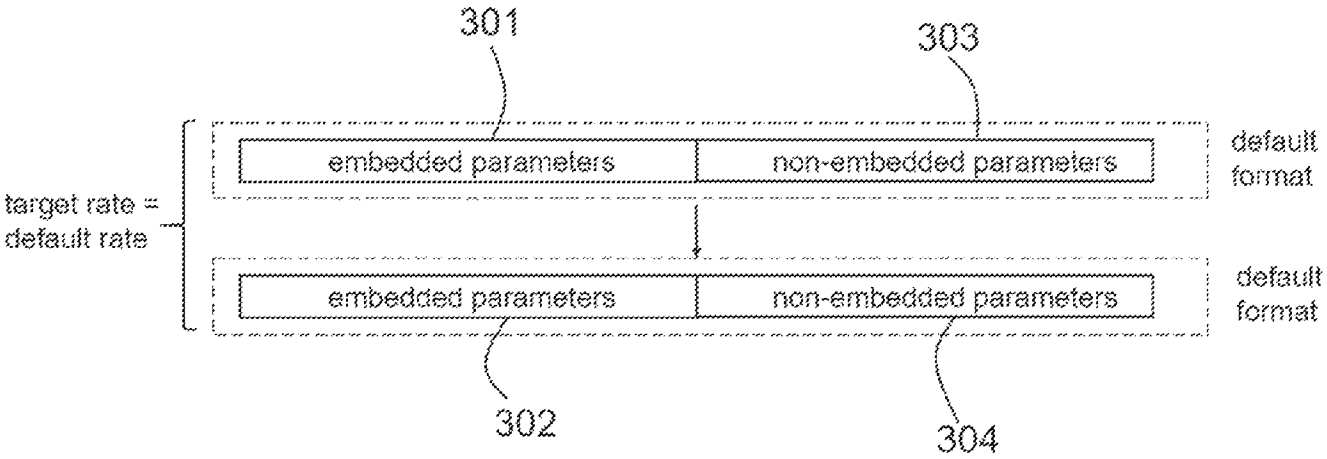
FIG. 3*a* illustrates a block diagram of an example of a converter which converts conditioning information from a target rate format by comparing default formats.

In the example of FIG. 3*a*, a block diagram of an example of a converter which converts conditioning information from a target rate format by comparing default formats is illustrated. In the example of FIG. 3*a*, the target bitrate is equal to the default bitrate. In this case, the converter may be configured to pass through, i.e. the conditioning parameters in the embedded parts, 301, 302, and in the non-embedded parts, 303, 304, correspond.

Figure 3B:
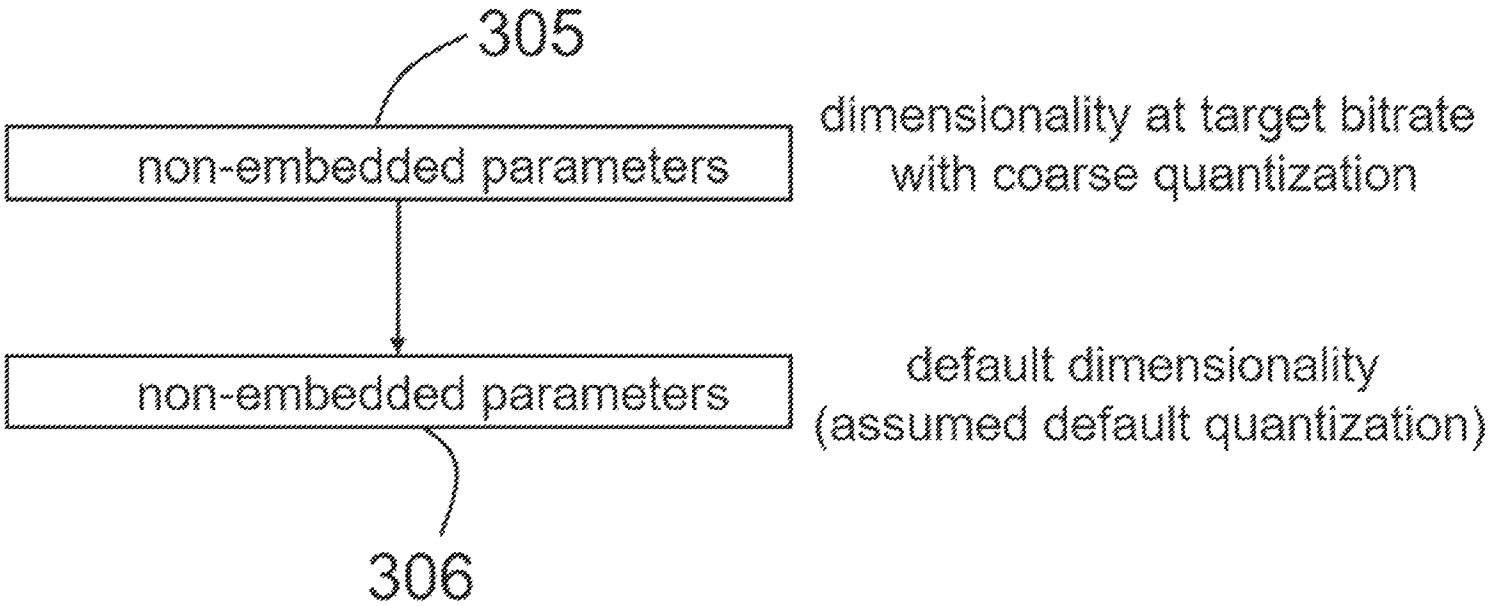
FIG. 3*b* illustrates a block diagram of an example of actions of the converter employing usage of coarse quantization instead of fine quantization.

Referring now to the example of FIG. 3*b*, a block diagram of an example of actions of the converter employing usage of coarse quantization instead of fine quantization is illustrated. The second, non-embedded part of the conditioning information may achieve a bitrate-quality trade-off by adjusting the coarseness of the quantizers. In an embodiment, the conditioning parameters of the non-embedded part of the conditioning information associated with the first bitrate, 305, may be quantized using a coarser quantizer than for the respective conditioning parameters of the non-embedded part of the conditioning information associated with the second bitrate, 306. In a case where the target bitrate (first bitrate) is lower than the default bitrate (second bitrate), the converter may provide coarse reconstruction (conversion) of the conditioning parameters within the non-embedded part of the conditioning information in their respective positions (where otherwise fine quantized values would be expected in the default format of the conditioning information).

Figure 3C:
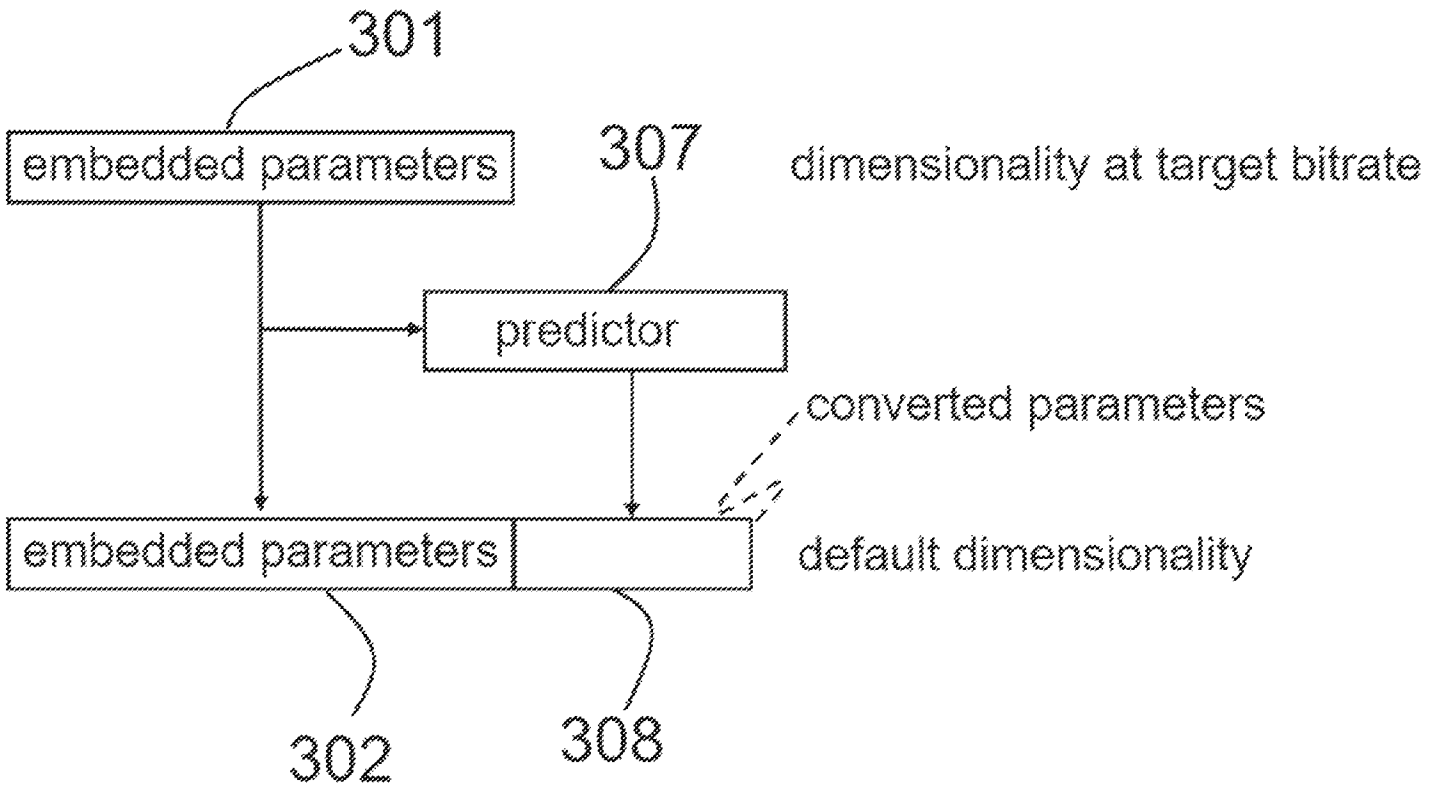
FIG. 3*c* illustrates a block diagram of an example of actions of the converter employing dimensionality conversion by prediction.

Referring now to the example of FIG. 3*c*, a block diagram of an example of actions of the converter employing dimensionality conversion by prediction is illustrated. In an embodiment, the converter may be configured to extend the dimensionality of the embedded part of the conditioning information associated with the first bitrate, 301, to the dimensionality of the embedded part of the conditioning information associated with the second bitrate, 302, by means of predicting, 307, for example by a predictor, any missing conditioning parameters, 308, based on the available conditioning parameters of the conditioning information associated with the first bitrate (target bitrate).

Figure 4:
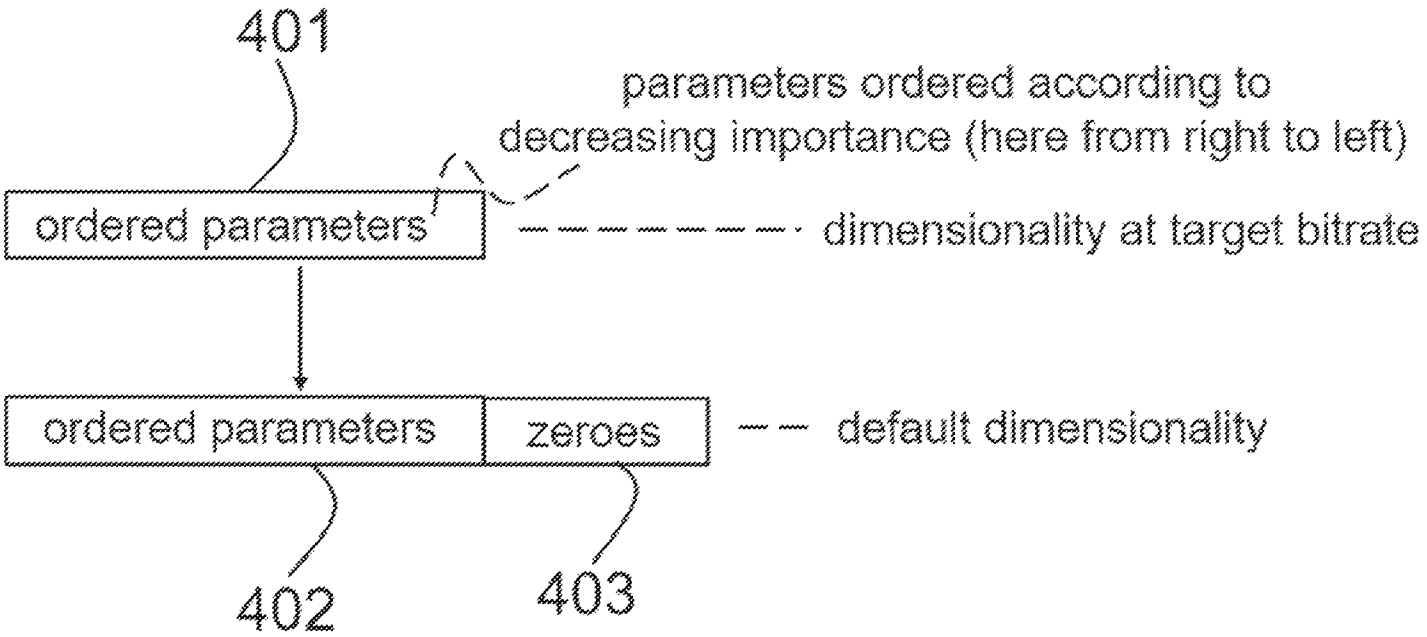
FIG. 4 illustrates a block diagram of an example of padding actions of the converter illustrating the embedded part of the conditioning information.

Referring further to the example of FIG. 4, a block diagram of an example of padding actions of the converter illustrating the embedded part of the conditioning information is illustrated. The padding operation of the reconstruction (conversion) may be configured to behave differently depending on the construction of the embedded part of the conditioning information. The padding may involve appending a sequence of variables with zeros to the default dimension. This may be used in the case where the embedded part comprises reflection coefficients (FIG. 4). The padding operation may comprise inserting predefined null symbols that indicate lack of conditioning information. Such null symbols may be used in the case where the embedded part of the conditioning information includes (i) a vector of subband energies ordered from low frequencies to high frequencies; (ii) coefficients of the Karhunen-Loeve transform; or (iv) coefficients of a frequency transform (e.g., MDCT, DCT). In an embodiment, the converter may thus be configured to extend the dimensionality of the embedded part of the conditioning information associated with the first bitrate, 401, to the dimensionality of the embedded part of the conditioning information associated with the second bitrate, 402, by means of zero padding, 403.

Generative Neural Network

In an embodiment, the generative neural network may be trained based on conditioning information in the format associated with the second bitrate. In an embodiment, the generative neural network may reconstruct the signal by performing sampling from a conditional probability density function, which is conditioned using the conditioning information in the format associated with the second bitrate. In an embodiment, the generative neural network may be a SampleRNN neural network.

For example, SampleRNN is a deep neural generative model which could be used for generating raw audio signals. It consists of a series of multi-rate recurrent layers, which are capable of modeling the dynamics of a sequence at different time scales. SampleRNN models the probability of a sequence of audio samples via factorization of the joint distribution into the product of the individual audio sample distributions conditioned on all previous samples. The joint probability distribution of a sequence of waveform samples $X=\{x_1, \ldots, x_T\}$ can be written as:

$$p(X)=\Pi_{i=1}^{T}p(x_i|x_1, \ldots, x_{i-1}) \quad (1)$$

At inference time, the model predicts one sample at a time by randomly sampling from $p(x_i|x_1, \ldots, x_{i-1})$. Recursive conditioning is then performed using the previously reconstructed samples.

Without conditioning information, SampleRNN is only capable of "babbling" (i.e., random synthesis of the signal). In an embodiment, the one or more conditioning parameters may be vocoder parameters. The decoded vocoder parameters, $h_f$, may be provided as conditioning information to the generative model. The above equation (1) thus becomes:

$$p(X|H)=\Pi_{i=1}^{T}p(x_i|x_1, \ldots, x_{i-1}, h_f) \quad (2)$$

where $h_f$ represents the vocoder parameters corresponding to the audio sample at time i. It can be seen that due to the usage of $h_f$, the model facilitates decoding.

In a K-tier conditional SampleRNN, the k-th tier ($1<k\leq K$) operates on non-overlapping frames of length $FS^{(k)}$ samples at a time, and the lowest tier (k=1) predicts one sample at a time. Waveform samples $x_{i-FS^{(k)}}, \ldots, x_{i-1}$ and decoded vocoder conditioning vector $h_f$ processed by respective 1×1 convolution layers are the inputs to k-th tier. When k<K, the output from the (k+1)-th tier is additional input. All inputs to the k-th tier are linearly summed up. The k-th RNN tier ($1<k\leq K$) consists of one gated recurrent unit (GRU) layer and one learned up-sampling layer performing temporal resolution alignment between tiers. The lowest (k=1) tier consists of a multilayer perceptron (MLP) with 2 hidden fully connected layers.

In an embodiment, the SampleRNN neural network may be a four-tier SampleRNN neural network. In the four-tier configuration (K=4), the frame size for the k-th tier is $FS^{(k)}$. The following frame sizes may be used: $FS^{(1)}=FS^{(2)}=2$, $FS^{(3)}=16$ and $FS^{(4)}=160$. The top tier may share the same temporal resolution as the vocoder parameter conditioning sequence. The learned up-sampling layer may be implemented through a transposed convolution layer, and the up-sampling ratio may be 2, 8, and 10, respectively, in the second, third and fourth tier. The recurrent layers and fully connected layers may contain 1024 hidden units each.

Encoder

Figure 5:
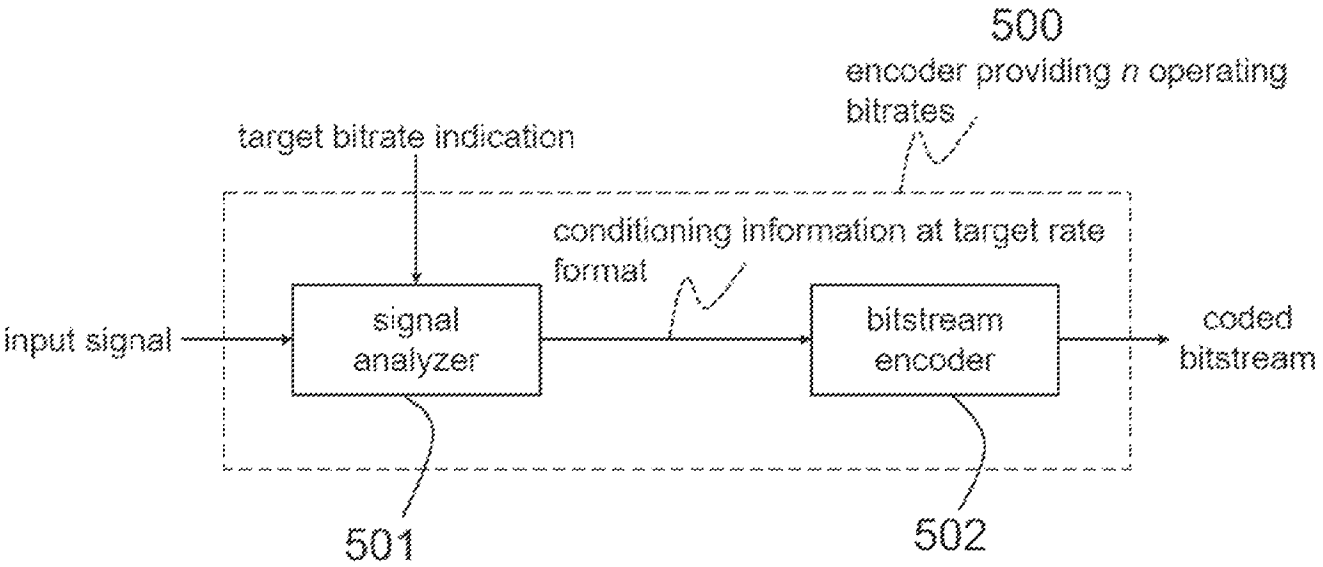
FIG. 5 illustrates a block diagram of an example of an encoder configured to provide conditioning information at a target rate format.

Referring now to the example of FIG. 5, a block diagram of an example of an encoder configured to provide conditioning information at a target rate format is illustrated. The encoder, 500, may include a signal analyzer, 501, and a bitstream encoder, 502.

The encoder, 500, is configured to provide at least two operating bitrates, including a first bitrate and a second bitrate, wherein the first bitrate is associated with a lower level of quality of reconstruction than the second bitrate, and wherein the first bitrate is lower than the second bitrate. In an embodiment, the first bitrate may belong to a set of multiple operating bitrates, i.e. n operating bitrates. The encoder, 500, may further be configured to provide conditioning information associated with the first bitrate including one or more conditioning parameters uniquely assigned to an embedded part and a non-embedded part of the conditioning information. The one or more conditioning parameters may be vocoder parameters. In an embodiment, a dimensionality, which is defined as a number of the conditioning parameters, of the embedded part of the conditioning information and of the non-embedded part of the conditioning information may be based on the first bitrate. Further, in an embodiment, the conditioning parameters of the embedded part may include one or more of reflection coefficients from a linear prediction filter, a vector of subband energies ordered from low frequencies to high frequencies, coefficients of the Karhunen-Loeve transform or coefficients of a frequency transform.

It is to be noted that the methods described herein may also be implemented by a system of the encoder and an apparatus for decoding an audio or speech signal as described above.

In the following, an encoder is described by way of example which is not intended to be limiting. An encoder scheme may be based on a wide-band version of a linear prediction coding (LPC) vocoder. Signal analysis may be performed on a per-frame basis, and it results in the following parameters:

i) an M-th order LPC filter;
ii) an LPC residual RMS level s;
iii) pitch $f_0$; and
iv) a k-band voicing vector v.

A voicing component v(i), i=1, . . . , k gives the fraction of periodic energy within a band. All these parameters may be used for conditioning of SampleRNN, as described above. The signal model used by the encoder aims at describing only clean speech (without background simultaneously active talkers).

TABLE 1

Operating points of the encoder (k = 6)

| $r_{nominal}$ [kb/s] | M | spectral dist. [dB] | n bits s | n bits $v_w$ |
|---|---|---|---|---|
| 8.0 | 22 | 0.754 | 1 + 9 | 9 |
| 6.4 | 16 | 0.782 | 1 + 8 | 9 |
| 5.6 | 16 | 1.33 | 1 + 8 | 9 |

The analysis scheme may operate on 10 ms frames of a signal sampled at 16 kHz. In the described example of an encoder design, the order of the LPC model, M, depends on the operating bitrate. Standard combinations of source coding techniques may be utilized to achieve encoding efficiency with appropriate perceptual consideration, including vector quantization (VQ), predictive coding and entropy coding. In this example, for all experiments, the operating points of the encoder are defined as in Table 1. Further, standard tuning practices are used. For example, the spectral distortion for the reconstructed LPC coefficients is kept close to 1 dB.

The LPC model may be coded in the line spectral pairs (LSP) domain utilizing prediction and entropy coding. For each LPC order, M, a Gaussian mixture model (GMM) was trained on a WSJ0 train set, providing probabilities for the quantization cells. Each GMM component has a $\mathbb{Z}$-lattice according to the principle of union of $\mathbb{Z}$-lattices. The final choice of quantization cell is according to a rate-distortion weighted criterion.

The residual level s may be quantized in the dB domain using a hybrid approach. Small level inter-frame variations are detected, signaled by one bit, and coded by a predictive scheme using fine uniform quantization. In other cases, the coding may be memoryless with a larger, yet uniform, step-size covering a wide range of levels.

Similar to level, pitch may be quantized using a hybrid approach of predictive and memoryless coding. Uniform quantization is employed but executed in a warped pitch domain. Pitch is warped by $f_w = cf_0/(c+f_0)$ where c=500 Hz and $f_w$ is quantized and coded using 10 bit/frame.

Voicing may be coded by memoryless VQ in a warped domain. Each voicing component is warped by $$v_w(i) = \log\left(\frac{1 - v(i)}{1 + v(i)}\right).$$

A 9 bit VQ was trained in the warped domain on the WSJ0 train set.

A feature vector $h_f$ for conditioning SampleRNN may be constructed as follows. The quantized LPC coefficients may be converted to reflection coefficients. The vector of reflection coefficients may be concatenated with the other quantized parameters, i.e. $f_0$, s, and v. Either of two constructions of the conditioning vector may be used. The first construction may be the straightforward concatenation described above. For example, for M=16, the total dimension of the vector $h_f$ is 24; for M=22 it is 30. The second construction may be an embedding of lower-rate conditioning into a higher-rate format. For example, for M=16, a 22-dimensional vector of the reflection coefficients is constructed by padding the 16 coefficients with 6 zeros. The remaining parameters may be replaced with their coarsely quantized (low bitrate) versions, which is possible since their locations within $h_f$ are now fixed.

Interpretation

Generally speaking, various example embodiments as described in the present disclosure may be implemented in hardware or special purpose circuits, software, logic or any combination thereof. Some aspects may be implemented in hardware, while other aspects may be implemented in firmware or software which may be executed by a controller, microprocessor or other computing device. While various aspects of the example embodiments of the present disclosure are described as block diagrams, flowcharts, or using some other pictorial representation, it will be appreciated that the blocks, apparatus, systems, techniques or methods described herein may be implemented in, as non-limiting examples, hardware, software, firmware, special purpose circuits or logic, general purpose hardware or controller or other computing devices, or some combination thereof.

Additionally, various blocks shown in flowcharts may be viewed as method steps, and/or as operations that result from the operation of computer program code, and/or as a plurality of coupled logic circuit elements constructed to carry out the associated function(s). For example, embodiments include a computer program product comprising a computer program tangibly embodied on a machine readable medium, the computer program containing program codes configured to carry out the methods as described above.

In the context of the disclosure, a machine readable medium may be any tangible medium that can contain, or store a program for use by or in connection with an instruction execution system, apparatus, or device. The machine readable medium may be a machine readable signal medium or a machine readable storage medium. A machine readable medium may include, but not limited to, an electronic, magnetic, optical, electromagnetic, infrared, or semiconductor system, apparatus, or device, or any suitable combination of the foregoing. More specific examples of the machine readable storage medium would include an electrical connection having one or more wires, a portable computer diskette, a hard disk, a random access memory (RAM), a read-only memory (ROM), an erasable programmable read-only memory (EPROM or Flash memory), an optical fiber, a portable compact disc read-only memory (CD-ROM), an optical storage device, a magnetic storage device, or any suitable combination of the foregoing.

Computer program code for carrying out methods described herein may be written in any combination of one or more programming languages. These computer program codes may be provided to a processor of a general purpose computer, special purpose computer, or other programmable data processing apparatus, such that the program codes, when executed by the processor of the computer or other programmable data processing apparatus, cause the functions/operations specified in the flowcharts and/or block diagrams to be implemented. The program code may be executed entirely on a computer, partly on the computer, as a stand-alone software package, partly on the computer and partly on a remote computer or entirely on the remote computer or server. The program code may be distributed on specially-programmed devices which may be generally referred to herein as "modules". Software component portions of the modules may be written in any computer language and may be a portion of a monolithic code base, or may be developed in more discrete code portions, such as is typical in object-oriented computer languages. In addition, the modules may be distributed across a plurality of computer platforms, servers, terminals, mobile devices and the like. A given module may even be implemented such that the described functions are performed by separate processors and/or computing hardware platforms.

As used in this application, the term "circuitry" refers to all of the following: (a) hardware-only circuit implementations (such as implementations in only analog and/or digital circuitry) and (b) to combinations of circuits and software (and/or firmware), such as (as applicable): (i) to a combination of processor(s) or (ii) to portions of processor(s)/software (including digital signal processor(s)), software, and memory(ies) that work together to cause an apparatus, such as a mobile phone or server, to perform various functions) and (c) to circuits, such as a microprocessor(s) or a portion of a microprocessor(s), that require software or firmware for operation, even if the software or firmware is not physically present. Further, it is well known to the skilled person that communication media typically embodies computer readable instructions, data structures, program modules or other data in a modulated data signal such as a carrier wave or other transport mechanism and includes any information delivery media.

Further, while operations are depicted in a particular order, this should not be understood as requiring that such operations be performed in the particular order shown or in sequential order, or that all illustrated operations be performed, to achieve desirable results. In certain circumstances, multitasking and parallel processing may be advantageous. Likewise, while several specific implementation details are contained in the above discussions, these should not be construed as limitations on scope or of what may be claimed, but rather as descriptions of features that may be specific to particular embodiments. Certain features that are described in this specification in the context of separate embodiments can also be implemented in combination in a single embodiment. Conversely, various features that are described in the context of a single embodiment can also be implemented in multiple embodiments separately or in any suitable sub-combination.

Various modifications and adaptations to the foregoing example embodiments may become apparent to those skilled in the relevant arts in view of the foregoing description, when it is read in conjunction with the accompanying drawings. Any and all modifications will still fall within the scope of the non-limiting and example embodiments. Furthermore, other embodiments will come to mind to one skilled in the art to which these embodiments pertain having the benefit of the teachings presented in the foregoing descriptions and the drawings.

The invention claimed is:

1. A method of decoding an audio or speech signal, the method including the steps of:

(a) receiving, by a receiver, a coded bitstream including the audio or speech signal and conditioning information;

(b) providing, by a bitstream decoder, decoded conditioning information in a format associated with a first bitrate;

(c) converting, by a converter, the decoded conditioning information from the format associated with the first bitrate to a format associated with a second bitrate, the first bitrate being lower than the second bitrate; and (d) providing, by a generative neural network, a reconstruction of the audio or speech signal according to a probabilistic model conditioned by the decoded conditioning information in the format associated with the second bitrate, wherein the generative neural network reconstructs the signal by performing sampling from a conditional probability density function, which is conditioned using the conditioning information in the format associated with the second bitrate, and wherein the generative neural network is a SampleRNN neural network;

wherein the conditioning information includes an embedded part and a non-embedded part;

wherein the conditioning information includes one or more conditioning parameters;

and wherein a dimensionality, which is defined as a number of the conditioning parameters, of the embedded part of the conditioning information associated with the first bitrate is lower than or equal to the dimensionality of the embedded part of the conditioning information associated with the second bitrate, and wherein the dimensionality of the non-embedded part of the conditioning information associated with the first bitrate is the same as the dimensionality of the non-embedded part of the conditioning information associated with the second bitrate.

2. The method according to claim 1, wherein the first bitrate is a target bitrate and the second bitrate is a default bitrate.

3. The method according to claim 1, wherein the one or more conditioning parameters are vocoder parameters.

4. The method according to claim 1, wherein the one or more conditioning parameters are uniquely assigned to the embedded part and the non-embedded part.

5. The method according to claim 4, wherein the conditioning parameters of the embedded part include one or more of reflection coefficients from a linear prediction filter, or a vector of subband energies ordered from low frequencies to high frequencies, or coefficients of the Karhunen-Loeve transform, or coefficients of a frequency transform.

6. The method according to claim 4, wherein step (c) further includes:

(i) extending the dimensionality of the embedded part of the conditioning information associated with the first bitrate to the dimensionality of the embedded part of the conditioning information associated with the second bitrate by means of zero padding; or (ii) extending the dimensionality of the embedded part of the conditioning information associated with the first bitrate to the dimensionality of the embedded part of the conditioning information associated with the second bitrate by means of predicting any missing conditioning parameters based on the available conditioning parameters of the conditioning information associated with the first bitrate.

7. The method according to claim 4, wherein step (c) further includes converting, by the converter, the non-embedded part of the conditioning information by copying values of the conditioning parameters from the conditioning information associated with the first bitrate into respective conditioning parameters of the conditioning information associated with the second bitrate.

8. The method according to claim 7, wherein the conditioning parameters of the non-embedded part of the conditioning information associated with the first bitrate are quantized using a coarser quantizer than for the respective conditioning parameters of the non-embedded part of the conditioning information associated with the second bitrate.

9. The method according to claim 1, wherein the generative neural network is trained based on conditioning information in the format associated with the second bitrate.

10. The method according to claim 1, wherein the SampleRNN neural network is a four-tier SampleRNN neural network.

11. An apparatus for decoding an audio or speech signal, wherein the apparatus includes:

(a) a receiver for receiving a coded bitstream including the audio or speech signal and conditioning information;

(b) a bitstream decoder for decoding the coded bitstream to obtain decoded conditioning information in a format associated with a first bitrate;

(c) a converter for converting the decoded conditioning information from a format associated with the first bitrate to a format associated with a second bitrate, the first bitrate being lower than the second bitrate; and (d) a generative neural network for providing a reconstruction of the audio or speech signal according to a probabilistic model conditioned by the decoded conditioning information in the format associated with the second bitrate, wherein the generative neural network reconstructs the signal by performing sampling from a conditional probability density function, which is conditioned using the conditioning information in the format associated with the second bitrate, and wherein the generative neural network is a SampleRNN neural network;

wherein the conditioning information includes an embedded part and a non-embedded part;

wherein the conditioning information includes one or more conditioning parameters;

and wherein a dimensionality, which is defined as a number of the conditioning parameters, of the embedded part of the conditioning information associated with the first bitrate is lower than or equal to the dimensionality of the embedded part of the conditioning information associated with the second bitrate, and wherein the dimensionality of the non-embedded part of the conditioning information associated with the first bitrate is the same as the dimensionality of the non-embedded part of the conditioning information associated with the second bitrate.

12. The apparatus according to claim 11, wherein the first bitrate is a target bitrate and the second bitrate is a default bitrate.

13. The apparatus according to claim 11, wherein the one or more conditioning parameters are vocoder parameters.

14. The apparatus according to claim 11, wherein the one or more conditioning parameters are uniquely assigned to the embedded part and the non-embedded part.

15. The apparatus according to claim 14, wherein the conditioning parameters of the embedded part include one or more of reflection coefficients from a linear prediction filter, or a vector of subband energies ordered from low frequencies to high frequencies, or coefficients of the Karhunen-Loeve transform, or coefficients of a frequency transform.

16. The apparatus according to claim 14, wherein the converter is further configured to:

(i) extend the dimensionality of the embedded part of the conditioning information associated with the first bitrate to the dimensionality of the embedded part of the conditioning information associated with the second bitrate by means of zero padding; or (ii) extend the dimensionality of the embedded part of the conditioning information associated with the first bitrate to the dimensionality of the embedded part of the conditioning information associated with the second bitrate by means of predicting any missing conditioning parameters based on the available conditioning parameters of the conditioning information associated with the first bitrate.

17. The apparatus according to claim 14, wherein the converter is further configured to convert the non-embedded part of the conditioning information by copying values of the conditioning parameters from the conditioning information associated with the first bitrate into respective conditioning parameters of the conditioning information associated with the second bitrate.

18. The apparatus according to claim 17, wherein the conditioning parameters of the non-embedded part of the conditioning information associated with the first bitrate are quantized using a coarser quantizer than for the respective conditioning parameters of the non-embedded part of the conditioning information associated with the second bitrate.

19. The apparatus according to claim 11, wherein the generative neural network is trained based on conditioning information in the format associated with the second bitrate.

20. The apparatus according to claim 11, wherein the SampleRNN neural network is a four-tier SampleRNN neural network.

21. An encoder including a signal analyzer and a bitstream encoder, wherein the encoder is configured to provide at least two operating bitrates, including a first bitrate and a second bitrate, wherein the first bitrate is associated with a lower level of quality of reconstruction than the second bitrate, and wherein the first bitrate is lower than the second bitrate;

wherein the encoder is further configured to provide conditioning information for conditioning of a SampleRNN neural network, the conditioning information being associated with the first bitrate including one or more conditioning parameters uniquely assigned to an embedded part and a non-embedded part of the conditioning information;

and wherein a dimensionality, which is defined as a number of the conditioning parameters, of the embedded part of the conditioning information and of the non-embedded part of the conditioning information is based on the first bitrate.

22. The encoder according to claim 21, wherein the conditioning parameters of the embedded part include one or more of reflection coefficients from a linear prediction filter, or a vector of subband energies ordered from low frequencies to high frequencies, or coefficients of the Karhunen-Loeve transform, or coefficients of a frequency transform.

23. The encoder according to claim 21, wherein the first bitrate belongs to a set of multiple operating bitrates.

* * * * *